US005580710A

United States Patent [19]

Takizawa et al.

[11] Patent Number: 5,580,710

[45] Date of Patent: Dec. 3, 1996

[54] SILVER HALIDE PHOTOGRAPHIC MATERIAL

[75] Inventors: Hiroo Takizawa; Yasuhiro Yoshioka; Masakazu Morigaki, all of Kanagawa, Japan

[73] Assignee: Fuji Photo Film Co., Ltd., Kanagawa, Japan

[21] Appl. No.: 532,518

[22] Filed: Sep. 22, 1995

[30] Foreign Application Priority Data

Oct. 7, 1994 [JP] Japan ..... 6-268165

[51] Int. Cl.[6] ..... G03C 7/392; G03C 7/36

[52] U.S. Cl. ..... 430/551; 430/546; 430/557

[58] Field of Search ..... 430/551, 546, 430/557

[56] References Cited

U.S. PATENT DOCUMENTS 5,028,519 7/1991 Morigaki et al. ..... 430/551

FOREIGN PATENT DOCUMENTS 2150349 7/1987 Japan ..... 430/551

2-262654 10/1990 Japan ..... G03C 7/26

*Primary Examiner*—Lee C. Wright

*Attorney, Agent, or Firm*—Sughrue, Mion, Zinn, Macpeak & Seas

[57] ABSTRACT

A silver halide color photographic material excellent in color forming property and wet heat image fastness comprising at least one compound represented by formula (I) in any layer formed on a support:

(I)

wherein $R_1$, $R_2$, $R_3$ and $R_4$ independently represent branched chain unsubstituted alkyl groups each having 3 to 20 carbon atoms with the proviso that the total carbon number of $R_1$, $R_2$, $R_3$ and $R_4$ is 16 to 60.

7 Claims, No Drawings

SILVER HALIDE PHOTOGRAPHIC MATERIAL

FIELD OF THE INVENTION

The present invention relates to a silver halide photographic material, and more particularly to a silver halide color photographic material in which dye images are stable to heat and moisture and especially yellow images are prevented from fading.

BACKGROUND OF THE INVENTION

Silver halide color photographic materials are well known to be subjected to imagewise exposure and color development, thereby allowing aromatic primary amine color developing agents to react with couplers to produce indophenol dyes, indoaniline dyes, indamine dyes, azomethine dyes, phenoxazine dyes, phenazine dyes and dyes similar thereto, thus forming color images.

In general, the quality of these photographic images is not lasting, but deteriorates with time during storage. In particular, for color photographs having images formed of azomethine dyes or indoaniline dyes, exposure to light or storage under high temperature and high humidity for a long period of time generally induces fading or discoloration of the dye images and further discoloration (yellow stains) of white grounds, resulting in deterioration of the images.

Such deterioration of the image quality is a drawback which may be said to be fatal to recording materials. It has been therefore desired to improve the drawback.

Cyan, magenta and yellow dye images are generally used in color photographs. Of these dyes, the magenta dyes are weakest to light. Investigations for improving the fastness of color photographs have therefore been made attaching importance to prevention of light fading of the magenta dyes. Various investigations have made it possible to improve the fastness of the magenta dyes to considerable levels. As a result, fading or discoloration of the yellow dyes or the cyan dyes has become outstanding.

Diacylpiperazine compounds having a specified structure are proposed in JP-A-2-262654 (the term "JP-A" as used herein means an "unexamined published Japanese patent application"). However, the compounds illustratively disclosed therein were insufficient to customers requesting much higher fastness, and particularly it was necessary to further heighten the effect of improving fading due to moisture, namely wet heat fastness. Moreover, many of the diacylpiperazine compounds illustratively disclosed are solid, although they are improved in solubility to high boiling organic solvents compared with the conventional compounds. They were therefore insufficient to use as high boiling organic solvents for dissolving couplers or other additives.

SUMMARY OF THE INVENTION

A first object of the present invention is therefore to provide a silver halide color photographic material considerably improved in fastness of color images.

A second object of the present invention is to provide a silver halide color photographic material improved in wet heat fastness.

A third object of the present invention is to provide a silver halide color photographic material containing a novel high boiling organic solvent to a coupler or an additive.

A fourth object of the present invention is to provide a silver halide color photographic material particularly considerably improved in wet heat fastness of a yellow or cyan image, thereby offering a fading color balance in fading aging of three colors of yellow, magenta and cyan.

The present inventors gave attention to acyl moieties during various studies of diacylpiperadines, and thoroughly studied them from all angles. As a result, the present inventors discovered that the objects of the present invention are attained by the following means:

(1) A silver halide color photographic material comprising at least one compound represented by the following formula (I) in any layer formed on a support:

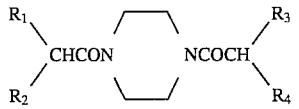

(I)

wherein $R_1$, $R_2$, $R_3$ and R4 independently represent branched chain unsubstituted alkyl groups each having 3 to 20 carbon atoms with the proviso that the total carbon number of $R_1$, $R_2$, $R_3$ and $R_4$ is 16 to 60;

(2) The silver halide color photographic material described in (1), in which in formula (I), $R_1$ and $R_3$ are independently branched chain unsubstituted alkyl groups each having 9 to 13 carbon atoms, and $R_2$ and $R_4$ are independently branched chain unsubstituted alkyl groups each having 7 to 11 carbon atoms; and (3) The silver halide color photographic material described in (1) or (2), in which $R_1$ and $R_3$ are sec-alkyl groups or have t-butyl or i-propyl sites at alkyl terminals.

DETAILED DESCRIPTION OF THE INVENTION

The compounds represented by formula (I) in the present invention are hereinafter described in detail.

In formula (I) in the present invention, the unsubstituted alkyl group means an alkyl group which is not substituted by a substituent other than an alkyl group. Further, the branched chain alkyl groups generally have several structures according to a branching manner, even though they have the same number of carbon atoms. For example, the branched chain alkyl groups include 3,5,5-trimethylhexyl, 2,2,4,4-tetramethylpentyl, 2,3,5-trimethylhexyl and 2-methyloctyl.

In formula (I), $R_1$ to $R_4$ each independently represents a branched chain unsubstituted alkyl group (hereinafter referred to as an unsubstituted branched alkyl group) having 3 to 20 carbon atoms with the proviso that the total carbon number of $R_1$ to $R_4$ is 16 to 60, preferably 32 to 48, more preferably 32 to 36, and further more preferably 32.

It is preferred that $R_1$ and $R_3$ are both independently unsubstituted branched alkyl groups each having 9 to 13 carbon atoms, and more preferably, $R_1$ and $R_3$ are both the same unsubstituted branched alkyl groups each having 9 to 13 carbon atoms. Further more preferably, $R_1$ and $R_3$ are both the same unsubstituted branched alkyl groups each having 9 or 10 carbon atoms, and most preferably, the same unsubstituted branched alkyl groups each having 9 carbon atoms.

It is preferred that $R_2$ and $R_4$ are both independently unsubstituted branched alkyl groups each having 7 to 11 carbon atoms, and more preferably, $R_2$ and $R_4$ are both the same unsubstituted branched alkyl groups each having 7 to 11 carbon atoms. Further more preferably, $R_2$ and $R_4$ are both the same unsubstituted branched alkyl groups each having 7 or 8 carbon atoms, and most preferably, the same unsubstituted branched alkyl groups each having 7 carbon atoms.

When $R_1$ and $R_3$ are both the same unsubstituted branched alkyl groups each having 9 carbon atoms, $R_2$ and $R_4$ are both preferably the same unsubstituted branched alkyl groups each having 7 carbon atoms, and when $R_1$ and $R_3$ are both the same unsubstituted branched alkyl groups each having 10 or 13 carbon atoms, $R_2$ and $R_4$ are both preferably the same unsubstituted branched alkyl groups each having 8 or 11 carbon atoms.

Among the above two combinations, the combination of that $R_1$ and $R_3$ are both the same unsubstituted branched alkyl groups each having 9 carbon atoms and that $R_2$ and $R_4$ are both the same unsubstituted branched alkyl groups each having 7 carbon atoms is more preferred.

On the other hand, in the branched chain alkyl groups of $R_l$ to $R_4$, it is preferred in the branching manner that $R_1$ and $R_3$ are sec-alkyl groups, or alkyl groups having t-butyl or i-propyl sites at alkyl terminals. Of these, more preferred are sec-alkyl groups having methyl groups at the 1-positions, or alkyl groups having t-butyl sites in the branching of the terminal position of the alkyl groups.

In particular, $R_1$ to $R_4$ are all preferably sec-alkyl groups, or alkyl groups substituted by t-butyl or i-propyl at alkyl terminals, and more preferably, $R_1$ to $R_4$ are all sec-alkyl groups having methyl groups at the 1-positions, or alkyl groups having t-butyl sites in the branching of the terminal position of the alkyl groups.

Examples of the compounds represented by formula (I) in the present invention include, but are not limited to, the following compounds.

Further, for example, when described as $C_8H_{17}$(i) in the formulas, the manner of branching may be either single or mixtures of some components.

Of these compounds, S-1 and S-8 are particularly preferred, and S-1 is most preferred.

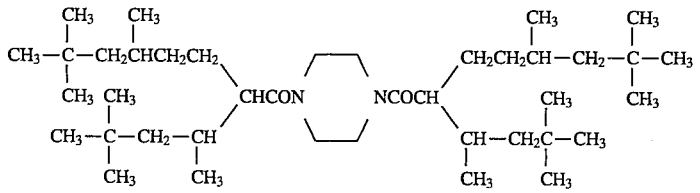

S-1

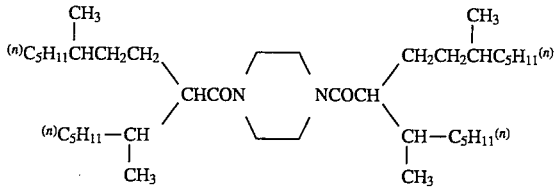

S-2

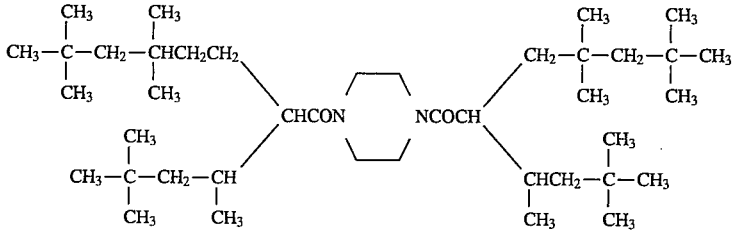

S-3

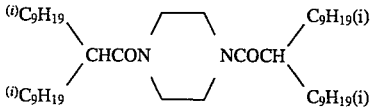

S-4

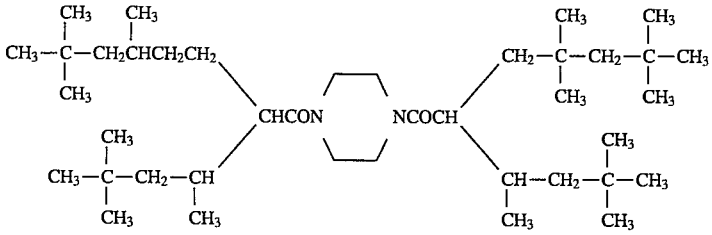

S-5

-continued
S-6
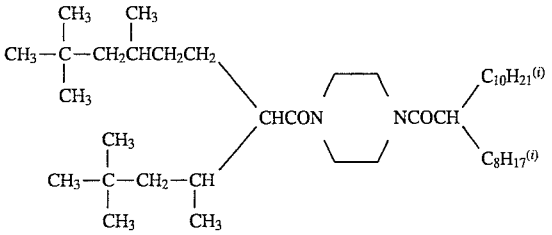
S-7
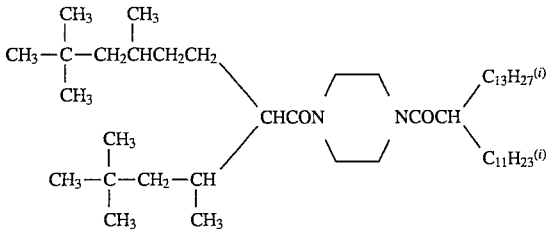
S-8
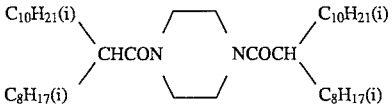
S-9
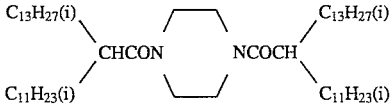
S-10
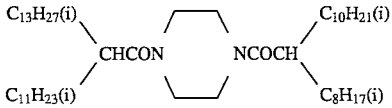
S-11
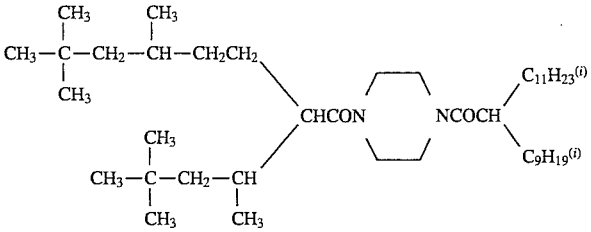
S-12
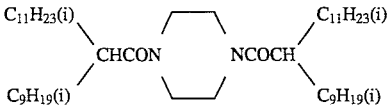
S-13
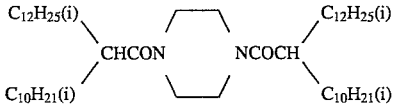
S-14
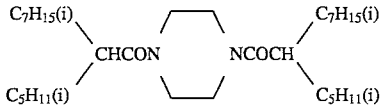
S-15
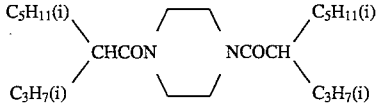

-continued

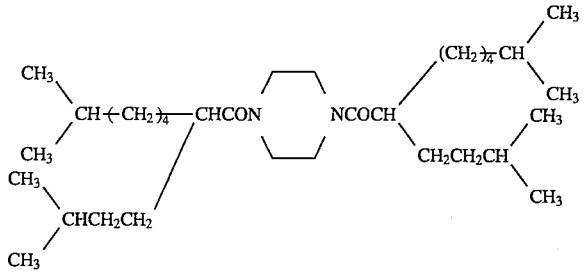

S-16

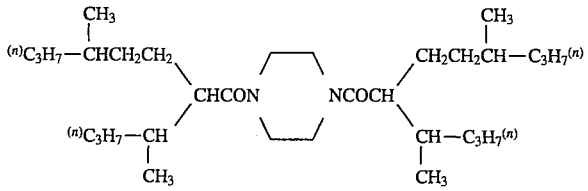

S-17

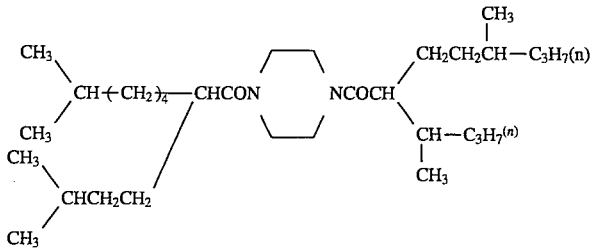

S-18

It is preferred that the compounds used in the present invention are synthesized from the carboxylic acid of the trade name of "Fine Oxocol" commercially available from Nissan Chemical Industries, Ltd. As "Fine Oxocol", for example, the following carboxylic acids are commercially available:

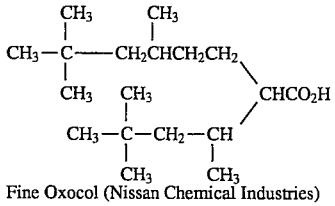

Fine Oxocol (Nissan Chemical Industries)
Isostearic Acid

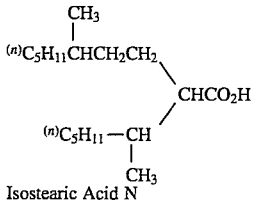

Isostearic Acid N

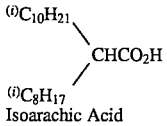

Isoarachic Acid

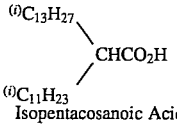

Isopentacosanoic Acid

-continued

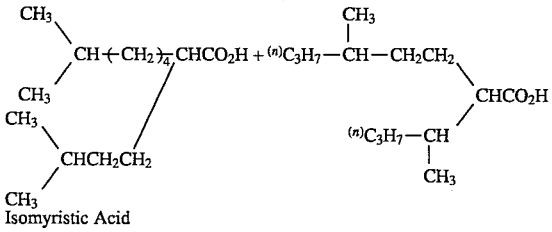

Isomyristic Acid

S-1 is also preferably a compound synthesized from "Fine Oxocol, isostearic acid".

A synthesis example of the compound represented by formula (I) in the present invention is shown below.

In general, the compounds used in the present invention can be easily synthesized by converting carboxylic acids into carboxylic acid chlorides using thionyl chloride, etc., and reacting them with anhydrous or hydrous piperazine using triethylamine, potassium carbonate or the like as a deoxidizer.

Synthesis of S-1

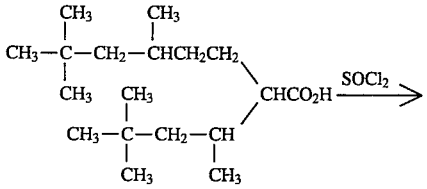

Nissan Chemical Industries Ltd.
"Fine Oxocol"
Isostearic Acid

-continued

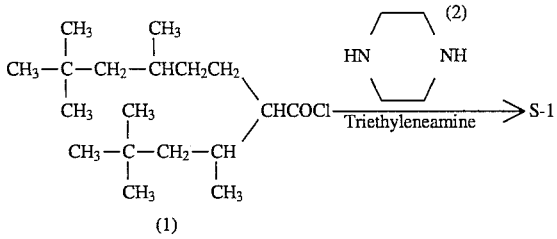

To 568.9 g (2 mol) of isostearic acid manufactured by Nissan Chemical Industries, Ltd., 1.0 g of DMF was added, and 261.8 g (2.2 mol) of thionyl chloride was added dropwise with stirring for 30 minutes. After stirring at room temperature for 30 minutes, the mixture was stirred at 40° C. for 30 minutes, and concentrated under reduced pressure with an aspirator to obtain 605.8 g of a carboxylic acid chloride (in a 100% yield). In 1250 ml of ethyl acetate, 86.1 g (1 mol) of anhydrous piperazine and 242.8 g (2.4 mol) of triethylamine were dissolved, followed by stirring under ice water cooling. Then, 605.8 g of the above-described carboxylic acid chloride was added dropwise thereto for 1 hour, and the mixture was further stirred for 30 minutes, followed by elevating the temperature to 50° C. and stirring for 1 hour.

Water was added in an amount of 500 ml to extract the organic phase. The extract was washed 3 times with water, and dried with magnesium sulfate, followed by concentration to obtain 607.0 g of pale yellow oily S-1 (in a 98.1% yield).

The structure was confirmed by NMR, IR and MS spectra and gas chromatography.

NMR spectrum (300 MHz, $CDCl_3$, δ: ppm) 1.0–1.2 (48H, S or d, $CH_3$) 1.2–2.0 (20H, m, —$CH_2$— or =CH—) 2.4–2.7 (2H, m, —CHCO<) 3.6–4.0 (8H, m, >$NCH_2CH_2N$<) MS spectrum 618 ($M^+$), 603, 551, 463, 353

The compounds represented by formula (I) in the present invention may be used alone or in combination with other compounds represented by formula (I), and may further be used in combination with known antifading agents.

Although the compounds represented by formula (I) in the present invention function as high boiling organic solvents, they may be used in combination with known high boiling solvents, and may further be used as additives such as stabilizers. The term "high boiling" as used herein means a boiling point of 175° C. or more at ordinary pressure.

The addition of the compound represented by formula (I) in the present invention to at least one layer of the photographic material is sufficient, and the compound is preferably used in a hydrophilic colloidal layer, particularly in a light-sensitive silver halide emulsion layer containing a coupler.

The amount of the compound of formula (I) used in the present invention can be varied depending on its purpose, and there is no particular limitation thereon. The amount of formula (I) used is preferably 0.0002 g to 20 g, more preferably 0.001 g to 5 g, per $m^2$ of photographic material. The weight ratio of the compound of formula (I) to a coupler used, for example, a coupler represented by formula (II) described below, is preferably within the range of 0.1 to 8, more preferably within the range of 0.1 to 4.0, and further more preferably within the range of 0.2 to 1.0.

When the compounds of the present invention are used in combination with the known high boiling solvents, the compounds of the present invention are used preferably in a weight ratio of 10% to 100% to the total amount of the high boiling solvents, and more preferably 20% to 70%.

Examples of the high boiling solvents which can be used in combination with the compounds of the present invention are described in U.S. Pat. No. 2,322,027. Examples of the high boiling solvents having a boiling point of 175° C. or more at ordinary pressure include phthalates [for example, dibutyl phthalate, dicyclohexyl phthalate, di-2-ethylhexyl phthalate, decyl phthalate, bis(2,4-di-tert-amylphenyl) phthalate, bis(2,4-di-tert-amylphenyl) isophthalate and bis(1,1-diethylpropyl) phthalate], phosphates or phosphonates (for example, triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphonate), benzoates (for example, 2-ethylhexyl benzoate, dodecyl benzoate, 2-ethylhexyl-p-hydroxybenzoate), amides (for example, N,N-diethyldodecanamide, N,N-diethyllaurylamide and N-tetradecylpyrrolidone), sulfonamides (for example, N-butylbenzenesulfonamide), alcohols or phenols (isostearyl alcohol and 2,4-di-tert-amylphenol), aliphatic carboxylic acid esters [for example, bis(2-ethylhexyl) sebacate, dioctyl azerate, glycerol tributylate, isostearyl lactate and trioctyl citrate], aniline derivatives (N,N-dibutyl-2-butoxy-5-tert-octylaniline acid), hydrocarbons (for example, paraffins, dodecylbenzene and diisopropylnaphthalene) and chlorinated paraffins. Further, organic solvents having a boiling point of 30° C. or more, preferably 50° C. to about 160° C. can be used as auxiliary solvents, and typical examples thereof include ethyl acetate, butyl acetate, ethyl propionate, methyl ethyl ketone, cyclohexanone, 2-ethoxyethyl acetate and dimethylformamide.

For attaining the objects of the present invention, an embodiment is preferred in which the compound represented by formula (I) in the present invention is contained in a layer particularly containing a yellow coupler, because the compound can prevent a yellow dye formed from the yellow coupler from fading. In particular, the objects of the present invention are markedly attained by a silver halide color photographic material comprising at least one layer in which the compound represented by formula (I) in the present invention and a yellow coupler represented by formula (II) are contained, said layer being formed on a support.

The yellow coupler represented by formula (II) is hereinafter described in detail.

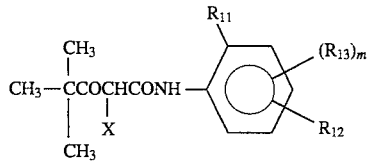

wherein $R_{11}$ represents a halogen atom, an alkoxy group or an aryloxy group; $R_{12}$ represents an acylamino group, an alkylsulfonamido group, an arylsulfonamido group, a carbamoyl group, an alkoxycarbonyl group, a sulfamoyl group, an alkylureido group, an arylureido group, an urethane group or an alkoxy group; $R_{13}$ represents a substituent; m represents an integer of 0 to 3; and X represents a group represented by any of the following formulas (III-1) to (III-4):

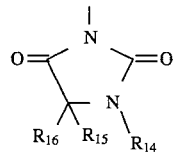

-continued (III-2)

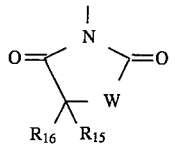

(III-3)

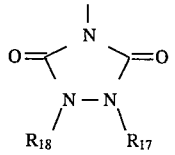

(III-4)

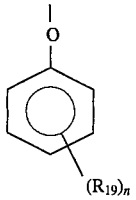

wherein $R_{15}$ and $R_{16}$ independently represent hydrogen atoms, alkyl groups, aryl groups, alkoxy groups, aryloxy groups or hydroxy groups; $R_{14}$, $R_{17}$ and $R_{18}$ independently represent hydrogen atoms, alkyl groups, aryl groups, aralkyl groups or acyl groups; W represents an oxygen atom or a sulfur atom; $R_{19}$ represents an alkylsulfonyl group, an arylsulfonyl group, an acyl group, a hydroxy group, a carboxyl group, a halogen atom or an alkoxycarbonyl group; and n represents an integer of 1 to 5.

The yellow coupler represented by formula (II) is described in more detail.

$R_{11}$ represents a halogen atom (for example, fluorine, chlorine, bromine or iodine), an alkoxy group preferably having 1 to 30 carbon atoms (for example, methoxy, ethoxy, i-propoxy, t-butoxy or benzyloxy) or an aryloxy group preferably having 6 to 36 carbon atoms (for example, phenoxy or 2,4-di-t-butylphenoxy), more preferably a halogen atom or an alkoxy group having 1 to 20 carbon atoms, further more preferably a chlorine atom or a methoxy group, and particularly preferably a chlorine atom.

$R_{12}$ preferably represents an acylamino group having 1 to 40 carbon atoms [for example, stearoylamino, 2-hexyldecanoyl-amino, benzoylamino or 2-(2,4-di-t-amylphenoxy)butanoyl-amino)], an alkylsulfonamido group having 1 to 40 carbon atoms (for example, dodecylsulfonamido or octylsulfonamido), an arylsulfonamido group having 1 to 40 carbon atoms [for example, 4-dodecylphenylsulfonamido or 2-octyloxy-5-(t-octyl)phenylsulfonamido], a carbamoyl group having 1 to 40 carbon atoms (for example, N-stearylcarbamoyl or N,N-dioctyl-carbamoyl), an alkoxycarbonyl group having 2 to 40 carbon atoms (for example, dodecyloxycarbonyl or 2-hexyldecyloxy-carbonyl), a sulfamoyl group having 0 to 40 carbon atoms (for example, N-dodecyloxysulfamoyl or N,N-dioctylsulfamoyl), an alkylureido group having 1 to 40 carbon atoms (for example, N-stearylureido or N,N-dioctylureido), an arylureido group having 6 to 40 carbon atoms (for example, N-phenylureido), a urethane group having 2 to 40 carbon atoms (for example, stearylurethane) or an alkoxy group having 1 to 40 carbon atoms (for example, dodecyloxy or 2-hexyldecyloxy), more preferably an acylamino group, an alkylsulfonamido group, an arylsulfonamido group, a carbamoyl group, an alkoxycarbonyl group or a sulfamoyl group, further more preferably an acylamino group, an alkylsulfonamido group, an arylsulfonamido group or an alkoxycarbonyl group, still further more preferably an acylamino group or an alkylsulfonamido group, and most preferably an acylamino group.

In formula (II), $R_{13}$ represents a substituent, such as an alkyl group preferably having 1 to 30 carbon atoms (for example, methyl, i-propyl or t-butyl), an alkoxy group preferably having 1 to 30 carbon atoms (for example, methoxy, i-propoxy, benzyloxy, 2-ethylhexyloxy or hexadecyloxy), an acylamino group preferably having 1 to 30 carbon atoms (for example, acetyl-amino, benzylamino or pivaloylamino), a carbamoyl group preferably having 1 to 30 carbon atoms (for example, N-methylcarbamoyl, N-phenylcarbamoyl, N,N-dibutylcarbamoyl or N-methyl-N-phenylcarbamoyl), an alkoxycarbonyl group preferably having 2 to 30 carbon atoms (for example, methoxycarbonyl, hexyloxycarbonyl or octadecyloxycarbonyl), an alkylsulfonamido group preferably having 1 to 30 carbon atoms (for example, methanesulfonamido, octanesulfonamido or hexadecane-sulfonamido), an arylsulfonamido group preferably having 6 to 36 carbon atoms (for example, benzene-sulfonamido or p-chlorobenzenesulfonamido), a cyano group, a nitro group, or a halogen atom (for example, chlorine or bromine), and more preferably an alkyl group, an alkoxy group or a halogen atom.

In formula (II), m represents an integer of 0 to 3, preferably 0 or 1, and more preferably 0.

The total number of carbon atoms of $R_{11}$, $R_{12}$ and $R_{13}$ is preferably 10 to 40, and more preferably 12 to 30.

Furthermore, the total number of carbon atoms of $R_{11}$ and $R_{12}$ is further more preferably 12 to 30, and the total number of carbon atoms of $R_{12}$ is particularly preferably 12 to 24.

In formula (I), X is represented by any of the above-described formulas (III-1) to (III-4).

$R_{15}$ and $R_6$ independently preferably represent hydrogen atoms, alkyl groups each having 1 to 20 carbon atoms (for example, methyl, ethyl, i-propyl, t-butyl or benzyl), aryl groups each having 6 to 26 carbon atoms (for example, phenyl, 2-naphthyl, 4-methoxyphenyl, 3-chlorophenyl or 2-methylphenyl), alkoxy groups each having 1 to 20 carbon atoms (for example, methoxy, ethoxy, i-propoxy or t-butoxy), aryloxy groups each having 6 to 26 carbon atoms (for example, phenoxy) or hydroxyl groups, more preferably hydrogen atoms, alkyl groups having 1 to 10 carbon atoms or alkoxy groups having 1 to 10 carbon atoms, and further more preferably hydrogen atoms, methyl groups, methoxy groups or ethoxy groups.

$R_{14}$, $R_{17}$ and $R_{18}$ each independently preferably represents a hydrogen atom, an alkyl group having 1 to 20 carbon atoms, an aryl group having 1 to 20 carbon atoms (preferred examples are the same as those of $R_{15}$), an aralkyl group having 7 to 20 carbon atoms (for example, benzyl or phenetyl) or an acyl group having 1 to 20 carbon atoms (for example, acetyl or benzoyl), more preferably a hydrogen atom, an alkyl group or an aralkyl group, and further more preferably a hydrogen atom, a methyl group, an ethyl group or a benzyl group.

In formula (III-3), W represents an oxygen atom or a sulfur atom, and preferably an oxygen atom.

In formula (III-4), $R_{19}$ preferably represents an alkylsulfonyl group having 1 to 20 carbon atoms (for example, octylsulfonyl or methylsulfonyl), an arylsulfonyl group having 6 to 26 carbon atoms (for example, phenylsulfonyl, 4-benzyloxyphenylsulfonyl or 4-hydroxyphenylsulfonyl), an acyl group having 1 to 20 carbon atoms (for example, acetyl or benzoyl), a hydroxyl group, a halogen atom (for example, chlorine or bromine), a carboxyl group or an alkoxycarbonyl group having 2 to 20 carbon atoms (for example, methoxysulfonyl or i-propyloxycarbonyl), and more preferably an arylsulfonyl group or an acyl group.

n represents an integer of 1 to 5, and preferably 1 or 2. When n is 2 or more, each $R_{19}$ may be the same or different. It is preferred that each $R_{19}$ is different.

In formula (III-1), a combination of a hydrogen atom as $R_{14}$ and methyl groups as $R_{15}$ and $R_{16}$, or a benzyl group as $R_{14}$, an ethoxy group as $R_{15}$ and a hydrogen atom as $R_{16}$, or a methyl group as $R_{14}$, a methoxy group as $R_{15}$ and a hydrogen atom as $R_{16}$ is preferred, and the combination of a hydrogen atom as $R_{14}$ and methyl groups as $R_{15}$ and $R_{16}$ is more preferred.

In formula (III-2), a combination of an oxygen atom as W and methyl groups as $R_{15}$ and $R_{16}$ is preferred.

As X in formula (II), formulas (III-1) and (III-2) are preferred, and (III-1) is more preferred.

Preferred examples of the yellow couplers used in the present invention are shown below, but this invention is not limited thereto.

(Y-1)

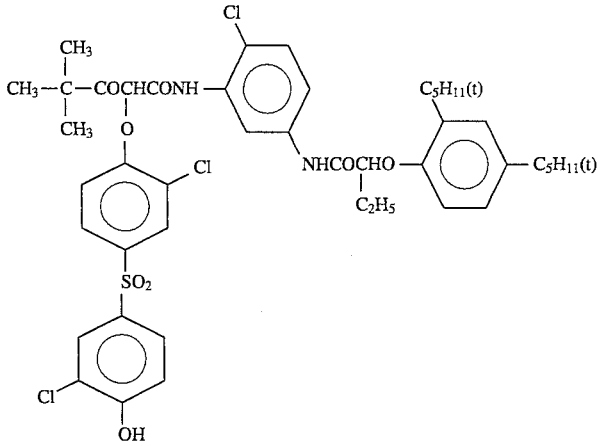

(Y-2)

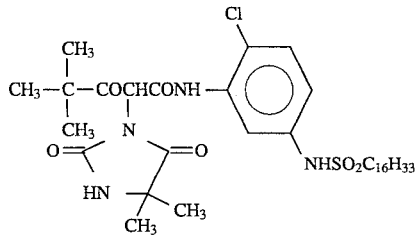

(Y-3)

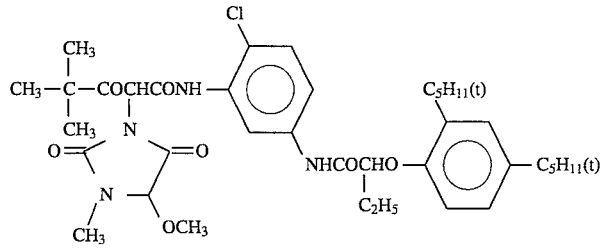

(Y-4)

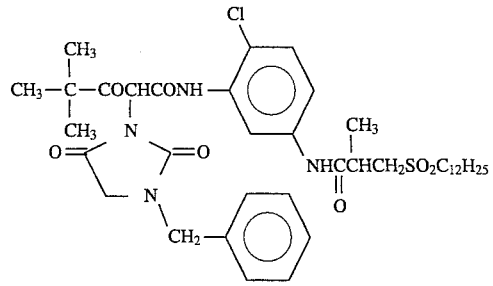

(Y-5)

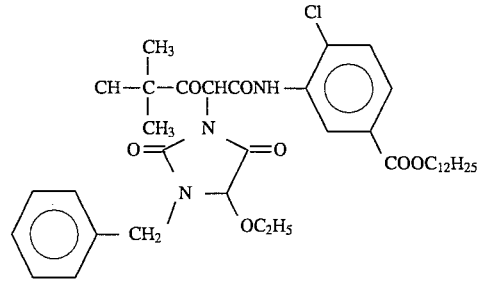

-continued
(Y-6)
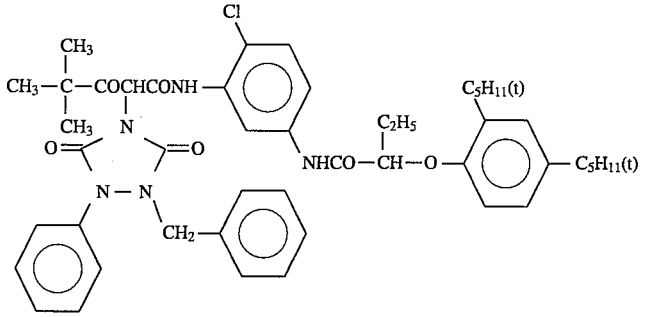
(Y-7)
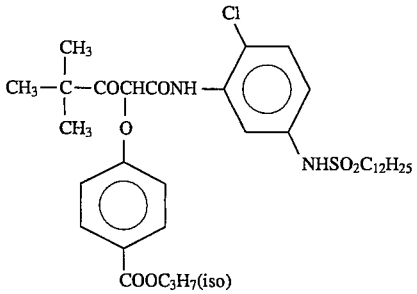
(Y-8)
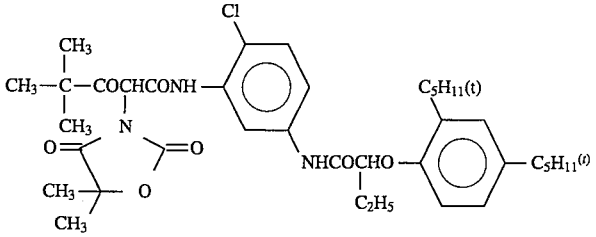
(Y-9)
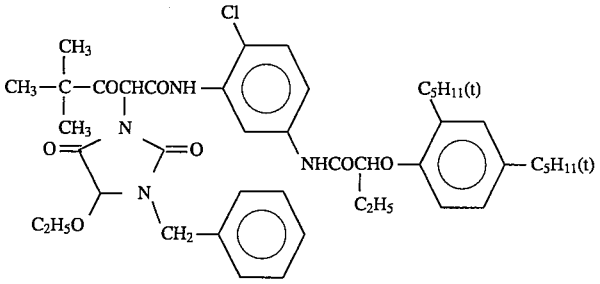
(Y-10)
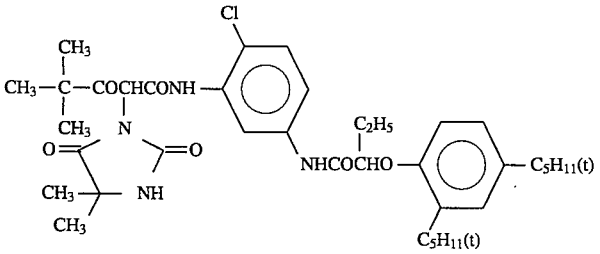
(Y-11)
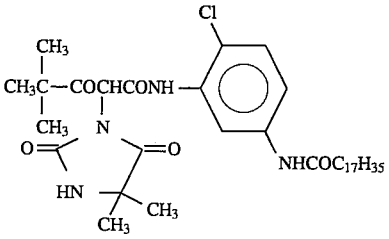

-continued
(Y-12)
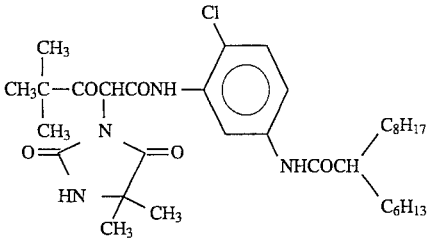
(Y-13)
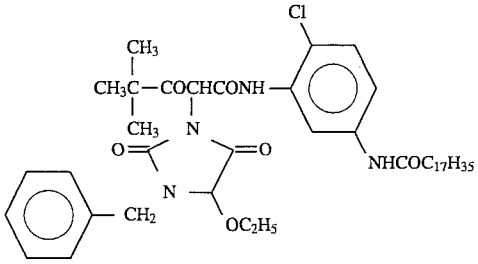
(Y-14)
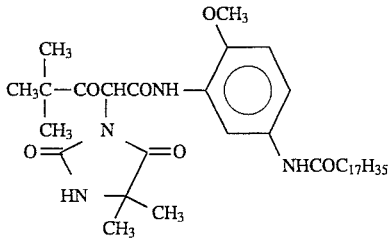
(Y-15)
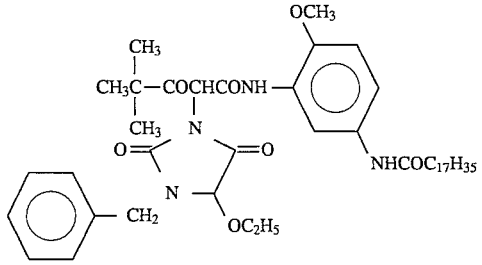
(Y-16)
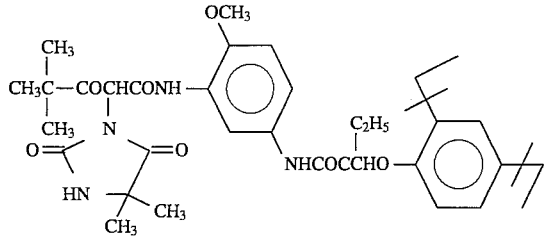
(Y-17)
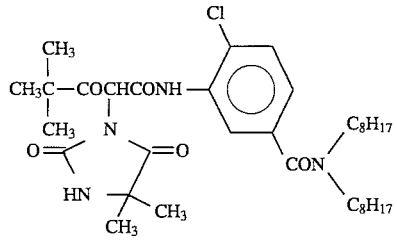

-continued (Y-18)

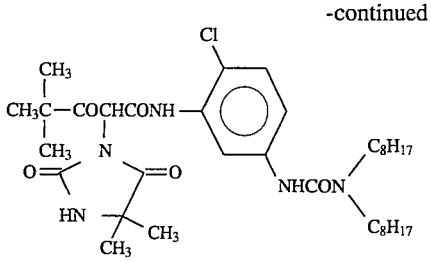

(Y-19)

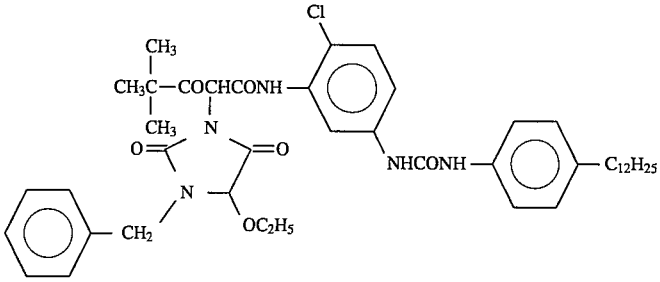

(Y-20)

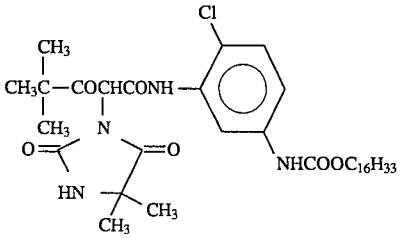

(Y-21)

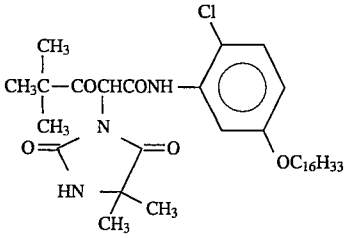

(Y-22)

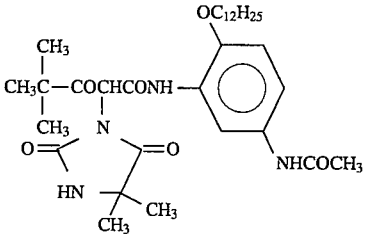

(Y-23)

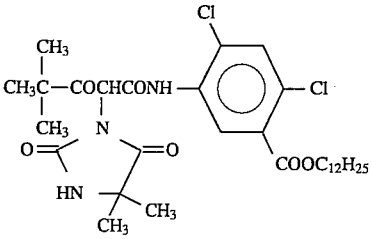

A layer containing the yellow coupler represented by formula (II) may be any layer, as long as it is a hydrophilic colloidal layer containing the compound represented by formula (I). However, it is preferably used in combination in a blue-sensitive silver halide emulsion layer.

The amount of the yellow coupler represented by formula (II) used in a silver halide color photographic material is preferably within the range of 0.01 to 10 mmol/m$^2$, more preferably within the range of 0.05 to 5 mmol/m$^2$, and most preferably within the range of 0.1 to 2 mmol/m$^2$. Of course, two or more kinds of couplers represented by formula (II) may be used in combination. Further, the coupler can also be used in combination with a coupler other than the coupler represented by formula (II).

A general photographic material can be constructed by forming at least one blue-sensitive silver halide emulsion layer, green-sensitive silver halide emulsion layer and red-sensitive silver halide emulsion layer in this order on a support, but they may be formed in an order different from this. Color reproduction by the subtractive color process can be conducted by allowing these light-sensitive emulsion layers to contain silver halide emulsions having sensitivity to respective wavelength regions and color couplers forming dyes in a complementary color relation to light to which they are exposed. However, the light-sensitive emulsion layers and developed color hues of the color couplers may not have the correspondence as described above.

Silver halide emulsions, other materials (such as additives) and photographic constituent layers (such as layer arrangement) applied in the present invention, and processing methods and additives for processing applied to process the photographic materials, which are preferably used, are described in JP-A-62-215272, JP-A-2-33144 and European Patent EP 0,355,660A2.

Furthermore, the silver halide color photographic materials and the methods for processing them described in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, European Patent EP 0,520,457A2, etc.

The silver halides used in the present invention include silver chloride, silver bromide, silver chlorobromide, silver iodochlorobromide and silver iodobromide. In particular, silver chlorobromide substantially free from silver iodide and having a silver chloride content of 90 mol % to 100 mol %, more preferably 95 mol % to 100 mol % and particularly 98 mol % to 100 mol %, or a pure silver chloride emulsion is preferably used for rapid processing.

In the photographic materials according to the present invention, it is preferred that dyes decolorizable by processing (oxonol dyes among others) described in European Patent 0,337,490A2, pages 27 to 76 are added to hydrophilic colloidal layers so that the optical reflection density of the photographic materials at 680 nm reaches 0.70 or more, or that 12% by weight or more (more preferably 14% by weight or more) of titanium oxide surface-treated with dihydric to tetrahydric alcohols (for example, trimethylolethane) is added to water-resistant resin layers of supports, for an improvement in sharpness of images.

Further, in the photographic materials according to the present invention, compounds for improving the keeping quality of color images as described in European Patent 0,277,589A2 are preferably used in combination with the couplers. In particular, they are preferably used in combination with pyrazoloazole magenta couplers.

Namely, in order to prevent the production of stains caused by the formation of a forming dye due to reaction of a color developing agent remaining in a film or an oxidation product thereof with a coupler during storage after processing, and other side effects, it is preferred to use compound (F) of European Patent 0,277,589A2 which is chemically bonded to an aromatic amine developing agent remaining after color development to form a chemically inactive, substantially colorless compound and/or compound (G) of European Patent 0,277,589A2 which is chemically bonded to an oxidation product of an aromatic amine color developing agent remaining after color development to form a chemically inactive, substantially colorless compound, alone or in combination.

Further, it is preferred that antifungal agents as described in JP-A-63-271247 are added to the photographic materials according to the present invention to prevent various molds and bacteria from breeding in the hydrophilic colloidal layers to deteriorate images.

Further, as a support used in the photographic material according to the present invention, a white polyester support or a support provided with a white pigment-containing layer on the side coated with silver halide emulsion layers may be used for a display. Furthermore, in order to improve the sharpness, an antihalation layer is preferably formed on the side coated with silver halide emulsion layers or on the back surface of a support. In particular, it is preferred that the transmission density is established within the range of 0.35 to 0.8 so that the display can be appreciated with both reflected light and transmitted light.

The photographic materials according to the present invention may be exposed to visible light or infrared light. Exposing methods may be either low illuminance exposure or high illumination exposure for a short time. In particular, in the latter case, a laser scanning exposing method in which the exposing time is shorter than $10^{-4}$ second is preferred.

Moreover, in exposing, a band stop filter described in U.S. Pat. No. 4,880,726 is preferably used, whereby optical color mixing is eliminated and color reproducibility is markedly improved.

EXAMPLE 1

Using a triacetyl cellulose support having an undercoat, single-layer photographic material 101 for evaluation having the following layer constitution was prepared.

(Preparation of Emulsion Layer Coating Solution)

Solv-2 (dibutyl phthalate) was added in an amount of 60% by weight based on the coupler to 1.85 mmol of a yellow coupler (Y-10), and 10 ml of ethyl acetate was further added thereto to dissolve the coupler under heating. This solution was dispersed by emulsification in 33 g of a 14% aqueous solution of gelatin containing 3 ml of a 10% solution of sodium dodecylbenzenesulfonate. On the other hand, a silver chlorobromide emulsion (cubic, a 3:7 mixture (silver molar ratio) of a large-sized emulsion having a mean grain size of 0.88 μm and a small-sized emulsion having a mean grain size of 0.70 μm, coefficients of variation in grain size distribution for the respective emulsions being 0.08 and 0.10, each emulsion comprising silver halide grains in which 0.3 mol % of silver bromide is localized on part of the surface of each grain) was prepared. Chemical sensitization of this emulsion was carried out by adding a sulfur sensitizing agent and a gold sensitizing agent. This emulsion and the above-described emulsified product were mixed with each other to prepare a coating solution so as to give the following composition. As a hardener, sodium 1-oxy-3,5-dichloro-s-triazinate was used.

(Layer Constitution)

The layer constitution of the sample used in this experiment is shown below. Numerals indicate coated weights per $m^2$.

[Support]

Triacetyl Cellulose Support

[Emulsion Layer]

| | |
|---|---|
| Silver Chlorobromide (described above) | 3.0 mmol |
| Yellow Coupler (Y-10) | 1.0 mmol |
| Solv-2 (Dibutyl Phthalate) (60% by weight of coupler) | |
| Gelatin | 5.5 g |

[Protective Layer]

| | |
|---|---|
| Gelatin | 1.5 g |
| Acrylic Modified Copolymer of Polyvinyl Alcohol (degree of modification: 17%) | 0.15 g |
| Liquid Paraffin | 0.03 g |

Then, samples 102 to 155 were prepared in the same manner as with sample 101 with the exception that the yellow coupler and the high boiling organic solvent were replaced as shown in Table A. In this case, the coupler was replaced in an equimolar amount, and half the weight of the high boiling solvent was replaced by the high boiling solvents of the present invention and the compounds for comparison shown in Table A (Solv-2 was replaced in the same weight).

The above-described photographic materials 101 to 152 were subjected to imagewise exposure using an optical wedge, and thereafter processed according to processing stages shown below.

| Processing Stage | Temperature | Time |
|---|---|---|
| Color Development | 35° C. | 45 sec |
| Bleaching-Fixing | 35° C. | 45 sec |
| Stabilizing (1) | 35° C. | 20 sec |
| Stabilizing (2) | 35° C. | 20 sec |
| Stabilizing (3) | 35° C. | 20 sec |
| Stabilizing (4) | 35° C. | 20 sec |
| Drying | 80° C. | 60 sec |

(Four-tank countercurrent system from stabilizing (4) to stabilizing (1) was employed.)

The composition of each processing solution was as follows:

[Color Developing Solution]

| | Tank Solution |
|---|---|
| [Color Developing Solution] | |
| Water | 800 ml |
| 1-Hydroxyethylidene-1,1-diphosphonic Acid (60%) | 0.8 ml |
| Triethanolamine | 8.0 g |
| Sodium Chloride | 1.4 g |
| Potassium Bromide | 0.03 g |
| N,N-Diethylhydroxylamine | 4.6 g |
| Potassium Carbonate | 27 g |
| Sodium Sulfite | 0.1 g |
| N-Ethyl-N-(β-methanesulfonamido-ethyl)-3-methyl-4-aminoaniline ⅔ Sulfate Monohydrate | 4.5 g |
| Lithium Sulfate (anhydrous) | 2.7 g |
| Fluorescent Brightener (4,4'-diaminostilbene type) | 2.0 g |
| Water to make | 1000 ml |
| pH (adjusted with potassium hydroxide and sulfuric acid) | 10.25 |
| [Bleaching-Fixing Solution] | |
| Water | 400 ml |
| Ammonium Thiosulfate (700 g/liter) | 100 ml |
| Sodium Sulfite | 18 g |
| Ethylenediaminetetraacetic Acid Fe(III) Ammonium | 55 g |
| Disodium Ethylenediaminetetraacetate | 3 g |
| Glacial Acetic Acid | 9 g |
| Water to make | 1000 ml |
| pH (adjusted with acetic acid and ammonia) | 5.4 |
| [Stabilizing Solution] | |

-continued

| | Tank Solution |
|---|---|
| 1,2-Benzoisothiazoline-3-one | 0.02 g |
| Polyvinylpyrrolidone | 0.05 g |
| Water to make | 1000 ml |
| pH | 7.0 |

The color forming density of the samples after processing was measured with blue light, and the maximum color forming density thereof is shown in Table A.

Then, the samples were stored under the conditions of 80° C. and 70% RH for 14 days, followed by similar density measurement to determine the residual rate of color images. The residual rate of color images was determined for a point of exposure giving half the maximum color forming density at the initial density, and results are shown in Table A given below.

TABLE A

| Sample | Coupler | High Boiling Solvent | Dmax | Residual Rate of Color Images (80° C.-70%) | Remarks |
|---|---|---|---|---|---|
| 101 | Y-10 | Solv-2 | 2.00 | 60 | Comparison |
| 102 | Y-10 | S-1 | 2.04 | 87 | Invention |
| 103 | Y-10 | S-2 | 2.01 | 80 | Invention |
| 104 | Y-10 | S-8 | 2.04 | 86 | Invention |
| 105 | Y-10 | S-9 | 2.03 | 82 | Invention |
| 106 | Y-10 | S-16 | 2.02 | 83 | Invention |
| 107 | Y-9 | Solv-2 | 2.02 | 75 | Comparison |
| 108 | Y-9 | S-1 | 2.04 | 88 | Invention |
| 109 | Y-9 | S-8 | 2.04 | 86 | Invention |
| 110 | Y-11 | Solv-2 | 2.09 | 61 | Comparison |
| 111 | Y-11 | S-1 | 2.12 | 86 | Invention |
| 112 | Y-11 | S-8 | 2.11 | 85 | Invention |
| 113 | Y-13 | Solv-2 | 2.10 | 67 | Comparison |
| 114 | Y-13 | S-1 | 2.11 | 85 | Invention |
| 115 | Y-13 | S-8 | 2.11 | 84 | Invention |
| 116 | Y-14 | Solv-2 | 2.02 | 60 | Comparison |
| 117 | Y-14 | S-1 | 2.05 | 82 | Invention |
| 118 | Y-14 | S-8 | 2.04 | 81 | Invention |
| 119 | Y-15 | Solv-2 | 2.04 | 66 | Comparison |
| 120 | Y-15 | S-1 | 2.07 | 81 | Invention |
| 121 | Y-15 | S-8 | 2.06 | 80 | Invention |
| 122 | Y-12 | Solv-2 | 1.95 | 72 | Comparison |
| 123 | Y-12 | S-1 | 1.98 | 85 | Invention |
| 124 | Y-12 | S-8 | 1.97 | 82 | Invention |
| 125 | Y-1 | Solv-2 | 1.99 | 68 | Comparison |
| 126 | Y-1 | S-1 | 2.01 | 80 | Invention |
| 127 | Y-1 | S-8 | 2.00 | 79 | Invention |
| 128 | Y-2 | Solv-2 | 2.07 | 60 | Comparison |
| 129 | Y-2 | S-1 | 2.10 | 81 | Invention |
| 130 | Y-2 | S-8 | 2.09 | 78 | Invention |
| 131 | Y-3 | Solv-2 | 2.02 | 70 | Comparison |
| 132 | Y-3 | S-1 | 2.05 | 84 | Invention |
| 133 | Y-3 | S-8 | 2.04 | 83 | Invention |
| 134 | Y-4 | Solv-2 | 2.01 | 68 | Comparison |
| 135 | Y-4 | S-1 | 2.04 | 83 | Invention |
| 136 | Y-4 | S-8 | 2.03 | 80 | Invention |
| 137 | Y-5 | Solv-2 | 2.00 | 65 | Comparison |
| 138 | Y-5 | S-1 | 2.02 | 83 | Invention |
| 139 | Y-5 | S-8 | 2.02 | 81 | Invention |
| 140 | Y-6 | Solv-2 | 2.01 | 73 | Comparison |
| 141 | Y-6 | S-1 | 2.03 | 81 | Invention |
| 142 | Y-6 | S-8 | 2.02 | 80 | Invention |
| 143 | Y-7 | Solv-2 | 2.03 | 68 | Comparison |
| 144 | Y-7 | S-1 | 2.06 | 84 | Invention |
| 145 | Y-7 | S-8 | 2.05 | 83 | Invention |
| 146 | Y-8 | Solv-2 | 2.04 | 74 | Comparison |
| 147 | Y-8 | S-1 | 2.07 | 83 | Invention |
| 148 | Y-8 | S-8 | 2.06 | 83 | Invention |
| 149 | Y-10 | CS-1 | 2.01 | 74 | Comparison |
| 150 | Y-10 | CS-2 | 2.01 | 71 | Comparison |
| 151 | Y-11 | CS-1 | 2.10 | 68 | Comparison |
| 152 | Y-11 | CS-2 | 2.10 | 65 | Comparison |

TABLE A-continued

| Sample | Coupler | High Boiling Solvent | Dmax | Residual Rate of Color Images (80° C.-70%) | Remarks |
|---|---|---|---|---|---|
| 153 | Y-10 | Cpd-1 | 2.00 | 67 | Comparison |
| 154 | Y-9 | Cpd-1 | 2.02 | 73 | Comparison |
| 155 | Y-11 | Cpd-1 | 2.09 | 59 | Comparison |

CS-1

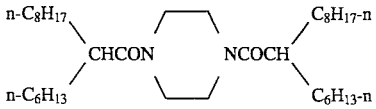

(Compound described in JP-A-2-262654)

CS-2

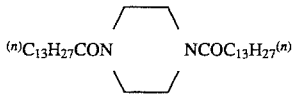

(Compound described in JP-A-2-26254)

Cpd-1

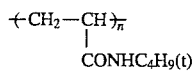

(Average molecular weight: 60,000)

Table A reveals that high color forming density and image fastness are be obtained for all the yellow couplers when the high boiling solvents of the present invention are used.

However, for CS-1 and CS-2 of JP-A-2-262654 and known cpd-1 similar to the high boiling solvents of the present invention in structure, but having straight chain or double branched alkyl groups, the effects of the present invention, namely an increase in color forming density and an improvement in fastness are only slightly observed.

EXAMPLE 2

A paper support both sides of which were laminated with polyethylene was subjected to corona discharge treatment and then provided with a gelatin underlayer containing sodium dodecylbenzenesulfonate. Various photographic constituent layers were further applied thereto. Thus, a multilayer color photographic paper sample (201) having the following layer constitution was prepared. Coating solutions were prepared as follows:

Preparation of Coating Solution for First Layer 122.0 g of yellow coupler (Y-15), 7.5 g of color image stabilizer (Cpd-2), 16.7 g of color image stabilizer (Cpd-3) and 8.0 g of color image stabilizer (Cpd-5) were dissolved in 22 g of solvent (Solv-3), 22 g of solvent (Solv-10) and 180 ml of ethyl acetate, and the resulting solution was dispersed by emulsification in 1000 g of a 10% aqueous solution of gelatin containing 86 ml of 10% sodium dodecylbenzenesulfonate to prepare an emulsified dispersion A. On the other hand, silver chlorobromide emulsion A (cubic, a 3:7 mixture (silver molar ratio) of large-sized emulsion A having a mean grain size of 0.88 μm and small-sized emulsion A having a mean grain size of 0.70 μm, coefficients of variation in grain size distribution for the respective emulsions being 0.08 and 0.10, each sized emulsion comprising silver halide grains in which 0.3 mol % of silver bromide is localized on part of the surface of each grain composed of a silver chloride substrate) was prepared. Each of the following blue-sensitive sensitizing dyes A, B and C was added to this emulsion in an amount of $8.0\times10^{-5}$ mol per mol of silver for large-sized emulsion A, and in an amount of $1.0\times10^{-4}$ mol for small-sized emulsion A. Chemical sensitization of this emulsion was carried out by adding a sulfur sensitizing agent and a gold sensitizing agent. The above-described emulsified dispersion and this solver chlorobromide emulsion A were mixed with each other to prepare a coating solution for a first layer so as to give the following composition. The amount of the emulsion applied indicates a coated weight converted to silver.

Coating solutions for second to seventh layers were prepared similarly to the coating solution for the first layer. As a gelatin hardener for each layer, the sodium salt of 1-oxy-3,5-dichloro-s-triazine was used.

Further, Cpd-12, Cpd-13, Cpd-14 and Cpd-15 were added to each layer to total amounts of 15.0 mg/m$^2$, 60.0 mg/m$^2$, 5.0 mg/m$^2$ and 10.0 mg/m$^2$, respectively.

In silver chlorobromide emulsions of respective light-sensitive emulsion layers, the following spectral sensitizing dyes were used.

Blue-Sensitive Emulsion Layer

Sensitizing Dye A

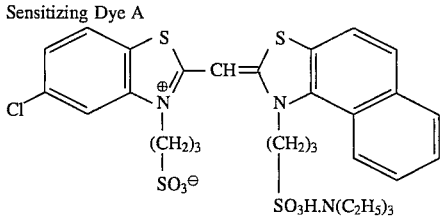

Sensitizing Dye B

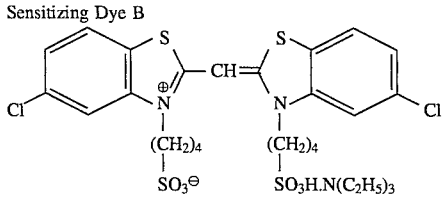

Sensitizing Dye C

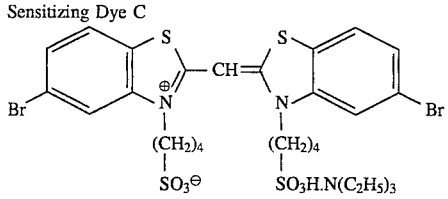

(Each was added in an amount of $1.4\times10^{-4}$ mol per mol of silver for a large-sized emulsion, and in an amount of $1.7\times10^{-4}$ mol for a small-sized emulsion.)

Green-Sensitive Emulsion Layer

Sensitizing Dye D

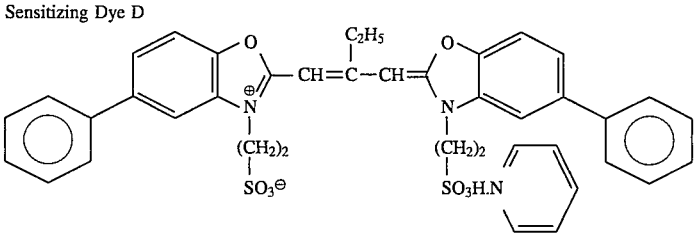

Sensitizing Dye E

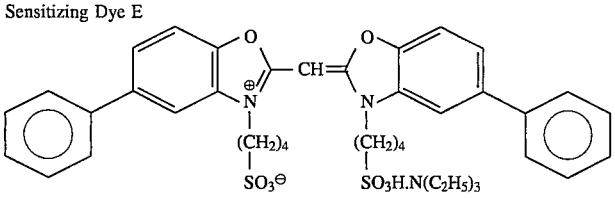

Sensitizing Dye F

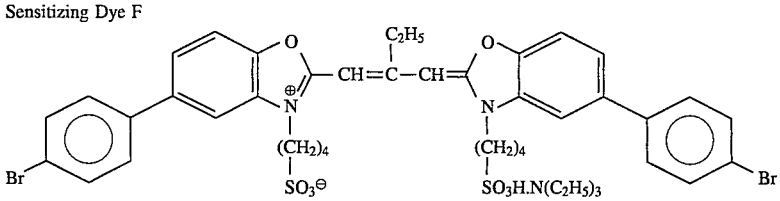

(Sensitizing dye D was added in an amount of $3.0\times10^{-4}$ mol per mol of silver halide for a large-sized emulsion, and in an amount of $3.6\times10^{-4}$ mol for a small-sized emulsion; sensitizing dye E was added in an amount of $4.0\times10^{-5}$ mol per mol of silver halide for a large-sized emulsion, and in an amount of $7.0\times10^{-5}$ mol for a small-sized emulsion; and sensitizing dye F was added in an amount of $2.0\times10^{-4}$ mol per mol of silver halide for a large-sized emulsion, and in an amount of $2.8\times10^{-4}$ mol for a small-sized emulsion.)

Red-Sensitive Emulsion Layer

Sensitizing Dye G

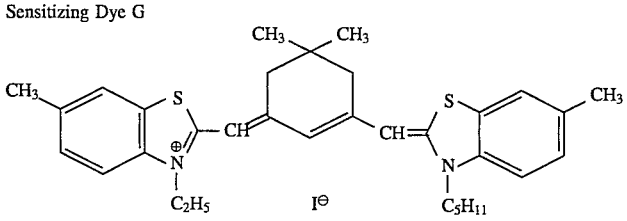

Sensitizing Dye H

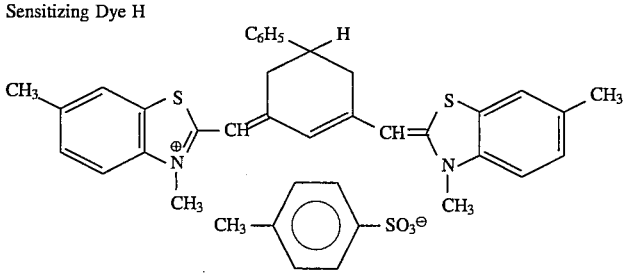

(Each was added in an amount of $5.0\times10^{-5}$ mol per mol of silver halide for a large-sized emulsion, and in an amount of $8.0\times10^{-5}$ mol for a small-sized emulsion.)

The following compound was further added to the red-sensitive emulsion layer in an amount of $2.6\times10^{-3}$ mol per mol of silver halide:

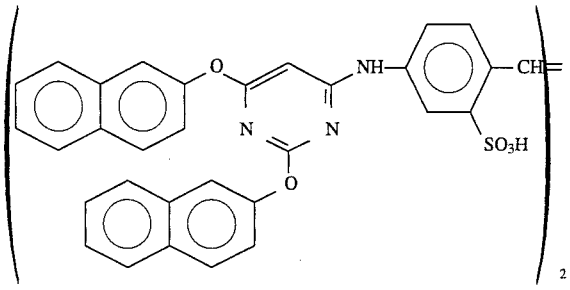

Further, 1-(5-methylureidophenyl)-5-mercaptotetrazole was added to the blue-sensitive emulsion layer, the green-sensitive emulsion layer and the red-sensitive emulsion layer in amounts of $3.3\times10^{-4}$ mol, $1.0\times10^{-3}$ mol and $5.9\times10^{-4}$ mol per mol of silver halide, respectively.

Furthermore, it was added to the second, fourth, sixth and seventh layers so as to give 0.2 mg/m$^2$, 0.2 mg/m$^2$, 0.6 mg/m$^2$ and 0.1 mg/m$^2$, respectively.

Moreover, 4-hydroxy-6-methyl-1,3,3a,7-tetraazaindene was added to the blue-sensitive emulsion layer and the green-sensitive emulsion layer in amounts of $1\times10^{-4}$ mol and $2\times10^{-4}$ mol per mol of silver halide, respectively.

In addition, the following dyes were added to the emulsion layers for prevention of irradiation (the numerical values in parentheses indicate coated weights).

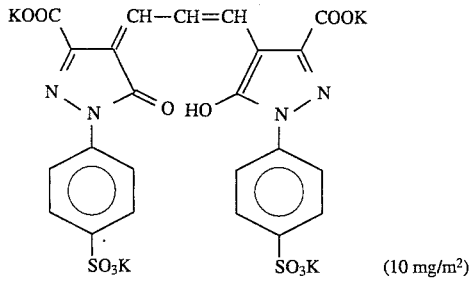

(10 mg/m$^2$)

and

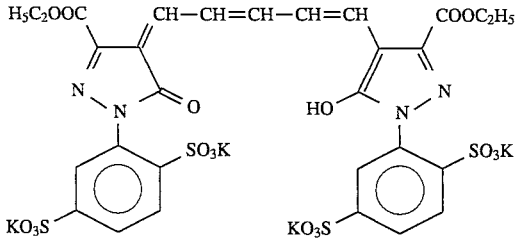

(40 mg/m$^2$)

(Layer Constitution)

The composition of each layer is shown below. The numerals indicate coated weights (g/m$^2$). For the silver halide emulsions, the numerals indicate coated weights converted to silver.

Support

Paper laminated with polyethylene [polyethylene on the side of the first layer contains a white pigment ($TiO_2$, content: 15 wt %) and a bluing dye (ultramarine)]

| | |
|---|---|
| First Layer (Blue-Sensitive Emulsion Layer) | |
| Silver Chlorobromide Emulsion A Described Above | 0.27 |
| Gelatin | 1.60 |
| Yellow Coupler (Y-15) | 0.61 |
| Color Image Stabilizer (Cpd-2) | 0.04 |
| Color Image Stabilizer (Cpd-3) | 0.08 |
| Color Image Stabilizer (Cpd-5) | 0.04 |
| Solvent (Solv-3) | 0.11 |
| Solvent (Solv-10) | 0.11 |
| Second Layer (Color Mixing Preventing Layer) | |
| Gelatin | 0.99 |
| Color Mixing Inhibitor (Cpd-4) | 0.10 |
| Solvent (Solv-1) | 0.07 |
| Solvent (Solv-2) | 0.20 |
| Solvent (Solv-3) | 0.15 |
| Solvent (Solv-7) | 0.12 |
| Third Layer (Green-Sensitive Emulsion Layer) | |
| Silver Chlorobromide Emulsion (cubic, a 1:3 mixture (silver molar ratio) of a large-sized emulsion B having a mean grain size of 0.55 μm and a small-sized emulsion B having a mean grain size of 0.39 μm, coefficients of variation in grain size distribution being 0.10 and 0.08, respectively, and 0.8 mol % of silver bromide being localized on part of the surface of each grain composed of a silver chloride substrate for each sized emulsion | 0.13 |
| Gelatin | 1.35 |
| Magenta Coupler (ExM-1) | 0.12 |
| Ultraviolet Light Absorber (UV-1) | 0.12 |
| Color Image Stabilizer (Cpd-2) | 0.01 |
| Color Image Stabilizer (Cpd-5) | 0.01 |
| Color Image Stabilizer (Cpd-6) | 0.01 |
| Color Image Stabilizer (Cpd-7) | 0.08 |
| Color Image Stabilizer (Cpd-8) | 0.01 |
| Solvent (Solv-4) | 0.30 |
| Solvent (Solv-5) | 0.15 |
| Fourth Layer (Color Mixing Preventing Layer) | |
| Gelatin | 0.72 |
| Color Mixing Inhibitor (Cpd-4) | 0.07 |
| Solvent (Solv-1) | 0.05 |
| Solvent (Solv-2) | 0.15 |
| Solvent (Solv-3) | 0.12 |
| Solvent (Solv-7) | 0.09 |
| Fifth Layer (Red-Sensitive Emulsion Layer) | |
| Silver Chlorobromide Emulsion (cubic, a 1:4 mixture (silver molar ratio) of a large-sized emulsion C having a mean grain size of 0.50 μm and a small-sized emulsion C having a mean grain size of 0.41 μm, coefficients of variation in grain size distribution being 0.09 and 0.11, respectively, and 0.8 mol % of silver bromide being localized on part of the surface of each grain composed of a silver chloride substrate for each sized emulsion | 0.18 |
| Gelatin | 0.80 |
| Cyan Coupler (ExC-1) | 0.28 |
| Ultraviolet Light Absorber (UV-3) | 0.19 |
| Color Image Stabilizer (Cpd-6) | 0.01 |
| Color Image Stabilizer (Cpd-8) | 0.01 |
| Color Image Stabilizer (Cpd-9) | 0.04 |
| Color Image Stabilizer (Cpd-10) | 0.01 |
| Solvent (Solv-1) | 0.01 |
| Solvent (Solv-6) | 0.21 |
| Sixth Layer (Ultraviolet Light Absorbing Layer) | |
| Gelatin | 0.64 |
| Ultraviolet Light Absorber (UV-2) | 0.39 |
| Color Image Stabilizer (Cpd-7) | 0.05 |
| Solvent (Solv-8) | 0.05 |
| Seventh Layer (Protective Layer) | |
| Gelatin | 1.01 |
| Acrylic Modified Copolymer of Polyvinyl | 0.04 |

-continued

| | |
|---|---|
| Alcohol (degree of modification: 17%) | |
| Liquid paraffin | 0.02 |
| Surface Active Agent (Cpd-11) | 0.01 |

Compounds used are shown below:

(ExM-1) Magenta Coupler

A 1:1 mixture (weight ratio) of

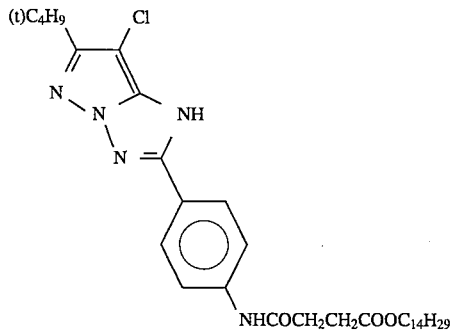

and

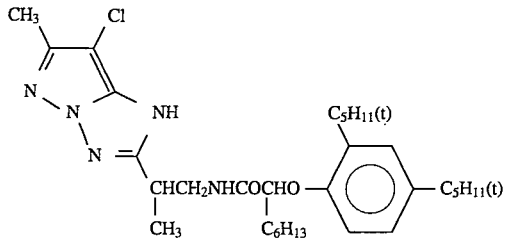

(ExC-1) Cyan Coupler

A 15:85 mixture (molar ratio) of

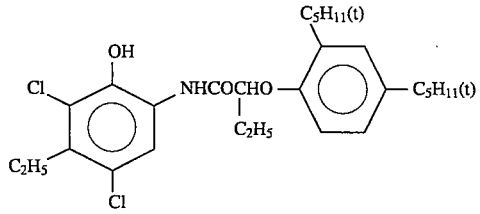

and

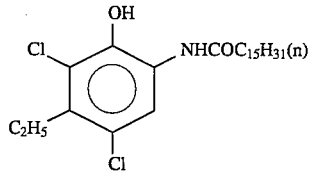

(Cpd-2) Color Image Stabilizer

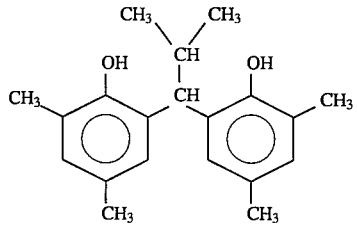

(Cpd-3) Color Image Stabilizer

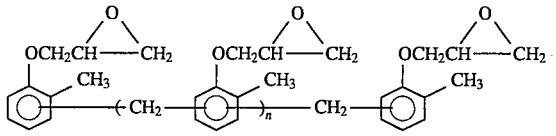

n = 7–8 (average value)

(Cpd-4) Color Mixing Inhibitor

A 1:1:1 mixture (weight ratio) of

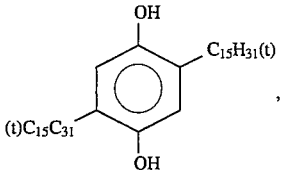

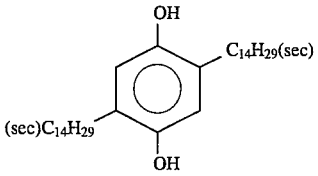

and

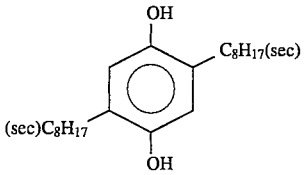

(Cpd-5) Color Image Stabilizer

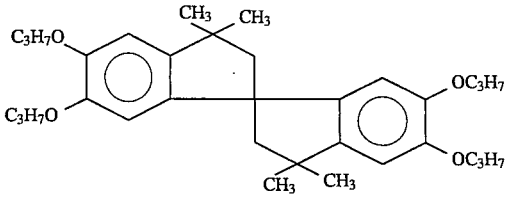

(Cpd-6) Color Image Stabilizer

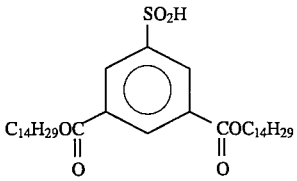

(Cpd-7) Color Image Stabilizer

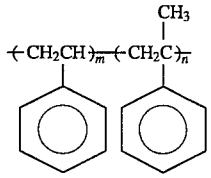

Number average molecular weight: 600 m/n=10/90

(Cpd-8) Color Image Stabilizer

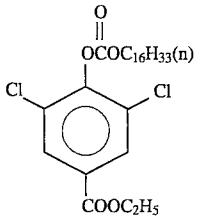

(Cpd-9) Color Image Stabilizer

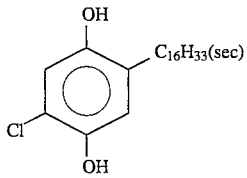

(Cpd-10) Color Image Stabilizer

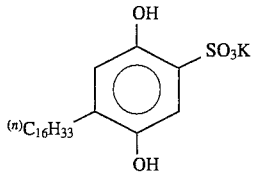

(Cpd-11) Surface Active Agent

A 7:3 mixture (weight ratio) of

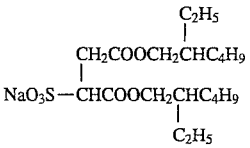

and

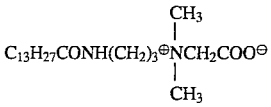

(Cpd-12) Preservative

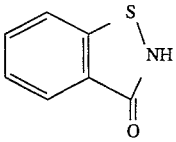

(Cpd-13) Preservative

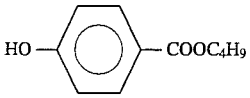

(Cpd-14) Preservative

A 1:1:1:1 mixture (weight ratio) of a, b, c and d

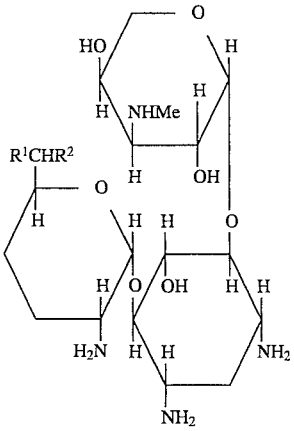

| | $R^1$ | $R^2$ |
|---|---|---|
| a | —Me | —NHMe |
| b | —Me | —$NH_2$ |
| c | —H | —$NH_2$ |
| d | —H | —NHMe |

(Cpd-15) Preservative

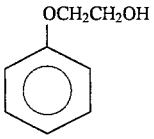

(UV-1) Ultraviolet Light Absorber

A 1:3:4 mixture (weight ratio) of (1), (2) and (3)

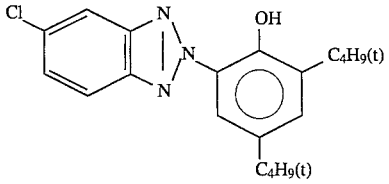

(1)

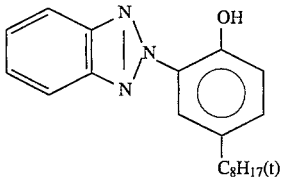

(2)

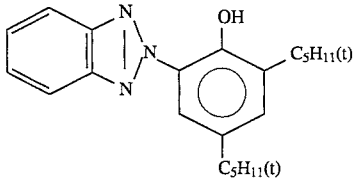

(3)

(UV-2) Ultraviolet Light Absorber

A 1:2:2:3:1 mixture (weight ratio) of (1), (2), (3), (4) and (5)

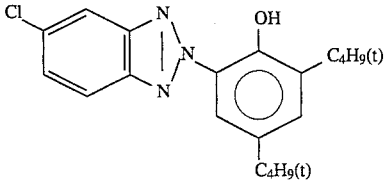

(1)

-continued (2)

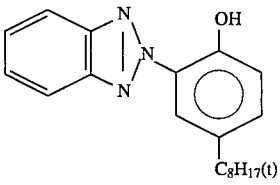

(3)

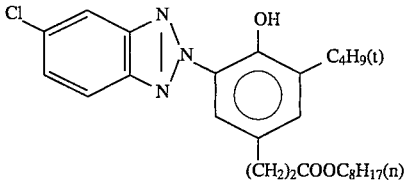

(4)

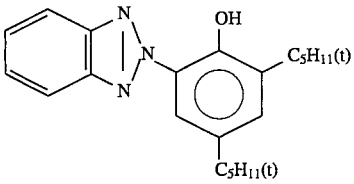

(5)

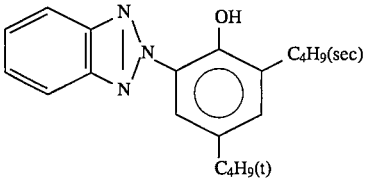

(UV-3) Ultraviolet Light Absorber

A 1:3:2:1 mixture (weight ratio) of (1), (2), (3) and (4)

(1)

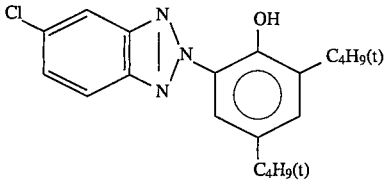

(2)

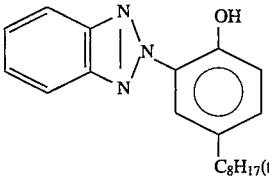

(3)

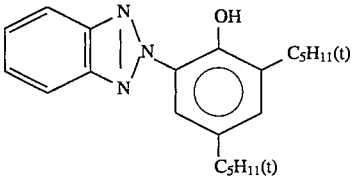

(4)

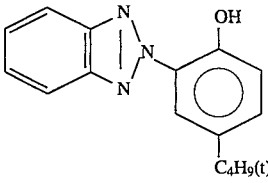

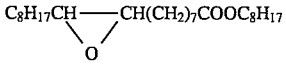

(Solv-1) Solvent

-continued

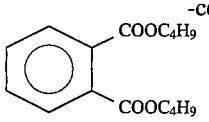

(Solv-2) Solvent

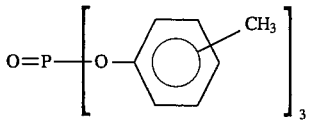

(Solv-3) Solvent (Solv-4) Solvent

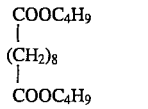

(Solv-5) Solvent

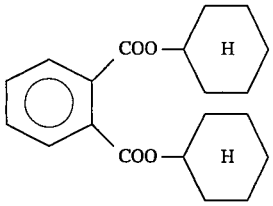

(Solv-6) Solvent

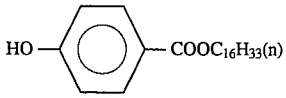

(Solv-7) Solvent

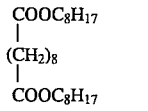

(Solv-8) Solvent

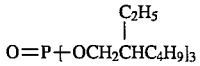

(Solv-10) Solvent

Samples 202 to 212 were prepared in the same manner as with sample 201 prepared as described above, with the exception that yellow coupler (Y-15) of the first layer was replaced as shown in Table B and 0.20 g of the compounds of the present invention and compositions for comparison were additionally added. In this case, the yellow coupler was replaced in an equimolar amount. Coupler ExY-2 shown in Table B is a 3:7 mixture (molar ratio) of (Y-20) and (Y-39).

Each sample was exposed using a sensitometer (manufactured by Fuji Photo Film Co., Ltd., FWH type, color temperature of light source: 3200° K.) so that about 35% of the amount of silver coated was developed to give grey.

The above-described samples were subjected to 50 $m^2$ continuous processing according to the following processing stages using a paper processor.

| Processing Stage | Temperature | Time | Replenish-* ment Rate |
|---|---|---|---|
| Color Development | 38.5° C. | 45 sec | 73 ml |
| Bleaching-Fixing | 35° C. | 45 sec | 60 ml** |
| Rinsing (1) | 35° C. | 30 sec | — |
| Rinsing (2) | 35° C. | 30 sec | — |
| Rinsing (3) | 35° C. | 30 sec | 360 ml |
| Drying | 80° C. | 60 sec | |

*Replenishment rate per $m^2$ of photographic material

**In addition to 60 ml described above, 120 ml per $m^2$ of photographic material was poured thereinto from rinsing (1).

(Three-tank countercurrent system from rinsing (3) to rinsing (1) was employed.)

The composition of each processing solution was as follows:

[Color Developing Solution]

| | Tank Solution | Replenisher |
|---|---|---|
| Water | 800 ml | 800 ml |
| Ethylenediaminetetraacetic Acid | 3.0 g | 3.0 g |
| Disodium 4,5-Dihydroxy-benzene-1,3-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Fluorescent Brightener (WHITEX 4, Sumitomo Chemical Co., Ltd.) | 1.0 g | 3.0 g |
| Sodium Sulfite | 0.1 g | 0.1 g |
| Disodium-N,N-bis(sulfonatoethyl)-hydroxylamine | 5.0 g | 10.0 g |
| Sodium Triisopropylnaphthalene-(β)sulfonate | 0.1 g | 0.1 g |
| N-Ethyl-N-(β-methanesulfonamido-ethyl)-3-methyl-4-aminoaniline-3/2 Sulfate.Monohydrate | 5.0 g | 11.5 g |
| Water to make | 1000 ml | 1000 ml |
| pH (25° C., adjusted with potassium hydroxide and sulfuric acid) | 10.00 | 11.00 |

[Bleaching-Fixing Solution]

| | Tank Solution | Replenisher |
|---|---|---|
| Water | 600 ml | 150 ml |
| Ammonium Thiosulfate (750 g/liter) | 93 ml | 230 ml |
| Ammonium Sulfite | 40 g | 100 g |
| Ethylenediaminetetraacetic Acid (III) Ammonium | 55 g | 135 g |
| Ethylenediaminetetraacetic Acid | 5 g | 12.5 g |
| Nitric Acid (67%) | 30 g | 65 g |
| Water to make | 1000 ml | 1000 ml |
| pH (25° C., adjusted with acetic acid and aqueous ammonia) | 5.8 | 5.6 |

[Rinsing Solution](tank solution and replenisher being the same)

| | |
|---|---|
| Chlorinated Sodium Isocyanurate | 0.02 g |
| Deionized Water (electric conductivity: 5 μs/cm or less) | 1000 ml |
| pH | 6.5 |

Then, each sample was subjected to gradation exposure with blue light, and processed with the above-described running processing solutions. The color forming density of each sample after processing was measured with blue light to determine the maximum yellow color forming density Dmax.

Then, each sample was stored at 80° C. at 70% RH for 20 days, and the residual rate of color images at an initial density of 1.0 was determined. These results are shown in Table B given below.

TABLE B

| Sample | Coupler | High Boiling Solvent | Dmax | Residual Rate of Color Images (80° C.-70%) | Remarks |
|---|---|---|---|---|---|
| 201 | Y-15 | Solv-3/ Solv-10 | 2.17 | 72 | Comparison |
| 202 | Y-15 | CS-1 | 2.20 | 74 | Comparison |
| 203 | Y-15 | CS-2 | 2.19 | 74 | Comparison |
| 204 | Y-15 | S-1 | 2.26 | 82 | Invention |
| 205 | Y-15 | S-8 | 2.25 | 81 | Invention |
| 206 | ExY-2 | Solv-3/ Solv-10 | 2.22 | 65 | Comparison |
| 207 | ExY-2 | CS-1 | 2.23 | 70 | Comparison |
| 208 | ExY-2 | CS-2 | 2.23 | 69 | Comparison |
| 209 | ExY-2 | S-1 | 2.25 | 83 | Invention |
| 210 | ExY-2 | S-8 | 2.24 | 82 | Invention |
| 211 | Y-15 | Cpd-1 | 2.17 | 70 | Comparison |
| 212 | ExY-2 | Cpd-2 | 2.22 | 64 | Comparison |

CS-1, CS-2, Cpd-1, Cpd-2 and Solv-2 are the same compounds as with Example 1.

As is apparent from Table B, use of the high boiling solvents of the present invention can realize concurrently high color forming property and image fastness under wet heat conditions. In particular, the fastness of ExY-2 to wet heat which is lower than that of Y-15 when Solv-3/Solv-10 is used can be remarkably improved by use of the compounds of the present invention. In contrast, the compounds of JP-A-2-262654 have only a slight effect to wet heat.

EXAMPLE 3

Samples 301 to 312 were prepared in the same manner as with sample 206, with the exception that the coupler of the fifth layer of sample 206 in Example 2 was changed as shown in Table C and 0.24 g of the high boiling organic solvents of the present invention and compositions for comparison were additionally added.

These samples were subjected to gradation exposure with red light, followed by the same processing as with Example 2. The density of each sample was measured with red light to determine the maximum color forming density.

Then, each sample was stored under the conditions of 80° C. and 70% RH for 2 weeks, and thereafter, the residual rate of color images was determined for an initial density of 2.0. Results are shown in Table C given below.

TABLE C

| Sample | Coupler | High Boiling Solvent | Dmax | Residual Rate of Color Images (80° C.-70%) | Remarks |
|---|---|---|---|---|---|
| 301 | ExC-1 | Solv-1/ Solv-6 | 2.10 | 76 | Comparison |
| 302 | ExC-1 | CS-1 | 2.11 | 82 | Comparison |
| 303 | ExC-1 | CS-2 | 2.11 | 80 | Comparison |
| 304 | ExC-1 | S-1 | 2.15 | 92 | Invention |
| 305 | ExC-1 | S-8 | 2.14 | 91 | Invention |
| 306 | ExC-2 | Solv-1/ Solv-6 | 2.09 | 81 | Comparison |
| 307 | ExC-2 | CS-1 | 2.11 | 86 | Comparison |
| 308 | ExC-2 | CS-2 | 2.10 | 85 | Comparison |
| 309 | ExC-2 | S-1 | 2.14 | 91 | Invention |
| 310 | ExC-2 | S-8 | 2.13 | 90 | Invention |
| 311 | ExC-1 | Cpd-1 | 2.10 | 78 | Comparison |
| 312 | ExC-2 | Cpd-1 | 2.09 | 83 | Comparison |

CS-1, CS-2 and Cpd-1 are the same compounds as with Example 1.

(ExC-2)

A 3:7 mixture (molar ratio) of

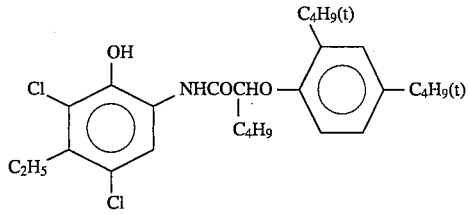

and

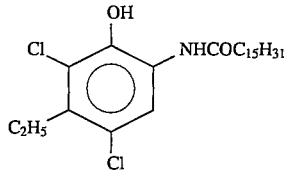

As is apparent from Table C, the photographic materials high in color forming and excellent in wet heat fastness can be obtained by using the high boiling solvents of the present invention in combination with coupler ExC-1 or ExC-2. In contrast, the compounds of JP-A-2-262654 have only a slight effect to wet heat.

The silver halide color photographic materials of the present invention are constructed as described above, so that they show the excellent effects that they are excellent in heat, moisture and color forming property, and further that they contain the high boiling organic solvents having high ability for dissolving organic materials such as dye forming couplers.

What is claimed is:

1. A silver halide color photographic material comprising a support having provided thereon at least one layer containing at least one compound represented by formula (I)

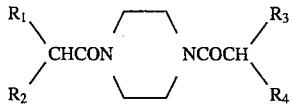

(I)

wherein $R_1$, $R_2$, $R_3$ and $R_4$ independently represent a branched and unsubstituted alkyl group having 3 to 20 carbon atoms with the proviso that the total carbon number of $R_1$, $R_2$, $R_3$ and $R_4$ is 16 to 60.

2. The silver halide color photographic material as claimed in claim 1, wherein $R_1$ and $R_3$ independently represent a branched and unsubstituted alkyl groups having 9 to 13 carbon atoms, and $R_2$ and $R_4$ independently represent a branched and unsubstituted alkyl group having 7 to 11 carbon atoms.

3. The silver halide color photographic material as claimed in claim 1, wherein $R_1$ and $R_3$ both represent a sec-alkyl group, or an alkyl group having a t-butyl or i-propyl site at the alkyl terminal.

4. The silver halide color photographic material as claimed in claim 2, wherein $R_1$ and $R_3$ both represent a sec-alkyl group, or an alkyl group having a t-butyl or i-propyl site at the alkyl terminal.

5. The silver halide color photographic material as claimed in claim 1, wherein said at least one layer containing the compound represented by formula (I) further contains a yellow coupler represented by formula (II)

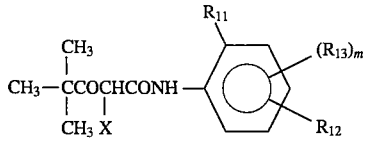

(II)

wherein $R_{11}$ represents a halogen atom, an alkoxy group or an aryloxy group; $R_{12}$ represents an acylamino group, an alkylsulfonamido group, an arylsulfonamido group, a carbamoyl group, an alkoxycarbonyl group, a sulfamoyl group, an alkylureido group, an arylureido group, an urethane group or an alkoxy group; $R_{13}$ represents a substituent; m represents an integer of 0 to 3; and X represents a group represented by any of formulas (III-1) to (III-4):

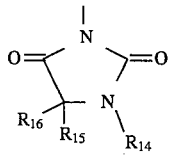

(III-1)

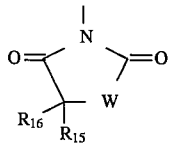

(III-2)

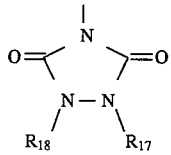

(III-3)

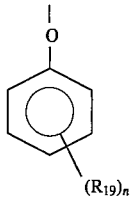

(III-4)

wherein $R_{15}$ and $R_{16}$ independently represent a hydrogen atom, an alkyl group, an aryl group, an alkoxy group, an aryloxy group or a hydroxyl group; $R_{14}$, $R_{17}$ and $R_{18}$ independently represent a hydrogen atom, an alkyl group, an aryl group, an aralkyl group or an acyl group; W represents an oxygen atom or a sulfur atom; $R_{19}$ represents an alkylsulfonyl group, an arylsulfonyl group, an acyl group, a hydroxyl group, a carboxyl group, a halogen atom or an alkoxycarbonyl group; and n represents an integer of 1 to 5.

6. The silver halide color photographic material as claimed in claim 1, wherein said at least one compound represented by formula (I) is used in an amount of 0.0002 g to 20 g per $m^2$ of the photographic material.

7. The silver halide color photographic material as claimed in claim 5, wherein said yellow coupler represented by formula (II) is used in an amount of 0.01 mmol to 10 mmol per $m^2$ of the photographic material.

* * * * *